United States Patent [19]

Kawamura et al.

[11] Patent Number: 4,570,311

[45] Date of Patent: Feb. 18, 1986

[54] METHOD FOR MANUFACTURING WATER SOLUBLE FABRIC FOR CHEMICAL LACES

[75] Inventors: Miichiro Kawamura; Mitsuru Fujihashi, both of Shiga, Japan

[73] Assignee: Firma Carl Freudenberg, Weinheim, Fed. Rep. of Germany

[21] Appl. No.: 446,335

[22] Filed: Dec. 2, 1982

[30] Foreign Application Priority Data

Dec. 7, 1981 [JP] Japan ..... 56-197461

[51] Int. Cl.[4] ..... D04C 1/02; D06M 1/00

[52] U.S. Cl. ..... 28/164; 8/114.6; 28/104; 28/168

[58] Field of Search ..... 28/164, 168, 104; 8/114.6

[56] References Cited

U.S. PATENT DOCUMENTS

| | | | |
|---|---|---|---|
| 2,365,315 | 12/1944 | Williams | 28/164 |
| 3,315,329 | 4/1967 | Yoshioka | 28/164 X |
| 3,377,678 | 4/1968 | Moriya | 28/164 |
| 3,917,785 | 11/1975 | Kalwaiter | 28/104 X |
| 3,966,522 | 6/1976 | Hatch et al. | 28/168 X |

FOREIGN PATENT DOCUMENTS

| | | | |
|---|---|---|---|
| 5035585 | 11/1975 | Japan | 28/168 |
| 7001024 | 1/1977 | Japan | 28/168 |

*Primary Examiner*—Werner H. Schroeder
*Assistant Examiner*—Andrew M. Falik
*Attorney, Agent, or Firm*—Kenyon & Kenyon

[57] ABSTRACT

A method for preparing water soluble fabric for chemical laces. The water soluble fabric is composed of webs of hot water soluble polyvinyl alcohol fibers and a water soluble resin fixably adhered to the fibers of which the fabric is composed.

7 Claims, 1 Drawing Figure

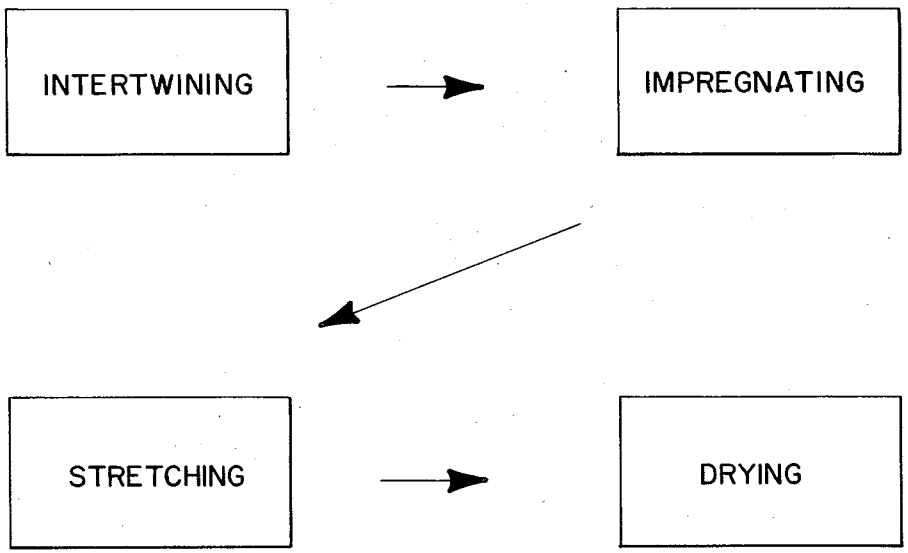
INTERTWINING
IMPREGNATING
STRETCHING
DRYING

METHOD FOR MANUFACTURING WATER SOLUBLE FABRIC FOR CHEMICAL LACES

FIELD OF THE INVENTION

The present invention relates to water soluble fabrics for use in the manufacture of chemical laces, and, in particular, to water soluble fabric for use in the manufacture of chemical laces composed of non-woven fabrics.

BACKGROUND OF THE INVENTION

Chemical lace is a type of machine made lace. A chemical lace is prepared by embroidering a fabric comprised of water soluble fibers, with a water insoluble cotton or synthetic thread. The embroidered fabric is then placed in hot water in order to dissolve the soluble fabric, leaving the lace product. Chemical laces are used for table cloths, curtains, ladies' garments, etc.

Woven fabrics comprised of water soluble polyvinyl alcohol fibers have been used in the manufacture of water soluble fabrics, useful in the preparation of chemical laces. However, these woven fabrics are disadvantageously expensive since they are prepared by weaving yarns produced by spinning. Thin fabrics woven from polyvinyl alcohol fibers are even more expensive.

Although attempts have been made to employ non-woven rather than woven fabrics in order to lower the price of water soluble fabrics, non-woven fabrics having properties suitable for use in the preparation of chemical laces have not yet been obtained. Although non-woven fabrics having a high longitudinal tensile strength have been conventionally manufactured, it has been remarkably difficult to obtain non-woven fabrics having a weight per unit of area of 20 to 80 g/m$^2$, a high tensile strength, and a low percent elongation in the direction of width, required of non-woven fabrics useful for preparing chemical laces.

The effective width of the conventional embroidering machine is 14.5 m. During the preparation of chemical lace, water soluble fabrics having a width larger than this width (14.5 m) are fed into the embroidering machine. The fabrics are always subjected to a tension of 1,000 to 1,500 kg. in the embroidering machine. When the elongation of the water soluble fabric in the direction of width is high relative to the tension, the embroidery pattern may slip out of position and, therefore, lace products of good quality are not obtained. In order to avoid this difficulty during the embroidering of water soluble fabrics, it is desirable for the elongation of the water soluble fabric to be as low as possible, while the tensile strength of the water soluble fabric is as high as possible.

With respect to conventional non-woven fabrics in which webs composed of hot water soluble polyvinyl alcohol fibers are merely combined with each other, the combination of fibers is destroyed by driving an embroidery needle into the non-woven fabrics, and this generates "slackness" in the fabric since an embroidery needle is driven into the fabric with a high tension, while non-woven fabrics naturally have a quite low tensile strength.

It is an object of the present invention to provide a method of manufacturing water soluble fabrics for chemical laces without the above described defects, that is to say, a water soluble fabric having a low percent elongation in the direction of the width of the fabric as well as a high tensile strength.

BRIEF DESCRIPTION OF THE INVENTION

In accordance with the foregoing, the present invention provides a method for manufacturing water soluble fabric for chemical laces, in which webs composed of hot water soluble polyvinyl alcohol fibers are subject to the action of fluid streams and, thereby, the fibers of which the webs are composed are intertwined to provide a fibrous sheet. The fibrous sheet is then impregnated with an aqueous solution of a water soluble resin, and the impregnated fibrous sheet is then stretched by 20% or more in the direction of width, and at the same time water is removed from said fibrous sheet by the application of heat sufficient to fixably adhere the resin to the fibers which comprise the sheet.

BRIEF DESCRIPTION OF THE DRAWING

The drawing shows a flow chart diagrammatically illustrating the different steps included in the water soluble fabric manufacturing method.

DETAILED DESCRIPTION OF THE INVENTION

Polyvinyl alcohol fibers useful herein include those like polyvinyl acetate saponified with alkali which is readily soluble in water at temperatures of about 40° C. to about 90° C. The polyvinyl acetate saponified with alkali may be copolymerized or mixed with other resins, or the like, in order to increase the solubility thereof. In this specification, the phrase "hot water soluble" means readily soluble in water having temperatures of about 40° C. to about 90° C.

The hot water soluble polyvinyl alcohol fibers are transformed into webs by means known in the art, such as by carding, air-laying and the like. The fibers which comprise the resulting webs are intertwined to produce fibrous sheets by spraying fluid streams such as liquid streams, air streams and the like over the fibrous webs, for example, by spraying webs mounted on a wire mesh conveyor belt with pressurized water, e.g., water at a pressure of about 40 Kg/cm$^2$. As a result of this step, tightly intertwined portions having a high fiber density, as well as comparatively loosely intertwined portions having a lower fiber density, are generated in the fibrous sheet. The resulting fibrous sheets are then sprayed or impregnated with an aqueous solution of water soluble resins, or the like. The impregnated fibrous sheets are than stretched by 20% or more, preferably 40% or more, in the direction of width of the fibrous sheet. Water is removed from the resulting fibrous sheets by the application of heat at temperatures at which the water soluble resins and polyvinyl alcohol fibers are not insolubilized.

During the drying step the water soluble resin migrates to produce a higher ratio of water soluble resin to fabric in the tightly intertwined areas of the fabric than is present in the loosely intertwined areas. The water soluble resins are fixably adhered concentrically between the fibers of the webs which comprise the fibrous sheet, and particularly concentrically between the intertwined portions of the fibrous sheet having the higher fiber density. The water soluble resins are fixably adhered within the intertwined portions of the fibrous sheet at a ratio of 60% or more by weight, preferably 70% or more by weight of the fibrous sheet. It is difficult to impart sufficient strength to the intertwined portions of the fibrous sheet if the water soluble resins are fixably adhered at a ratio of less than 60% by weight of the fibrous sheet.

In accordance with the present invention, the fibers of the fabric are not broken and do not slip out when an embroidery needle is driven into the fibrous sheets, since the fibers comprising the sheet are intertwined, and the water soluble resins are fixably adhered to the intertwined portions of the fibrous sheet.

Further, although the water soluble resins are fixably adhered to the comparatively loosely intertwined portions of the sheet which are stretched when the bundles of fibers are stretched in the direction of width, the water soluble resins are fixably adhered at a lower ratio than is present in tightly intertwined portions of the fibrous sheet. Fibers are apt to be broken by an embroidery needle when it is driven into the fibrous sheets if the water soluble resin is fixably adhered only to the loosely intertwined stretched portions of the fabric and this is rather undesirable.

Thus, in accordance with the present invention, it is desirable that water soluble resins are fixably adhered to intertwined portions at a higher ratio, while the water soluble resin is fixably adhered to the lossely intertwined portions of the fabric at a lower ratio, in order to increase tensile strength of the fabric.

Water soluble resins useful in the present invention include polyvinyl alcohol, polyethylene oxide, hydroxyalkylcellulose, carboxymethylcellulose, polyacrylamide, polyvinyl pyrrolidone, polyacrylate, starch and the like. In view of the coat-forming property, dissolution time, processibility of solution and the like, polyvinyl alcohol, which is the same material as that for forming fibrous webs, is preferably used. It is desirable that water soluble fabrics prepared in accordance with the present invention have a 10% modulus of 1.5 Kg/cm which is a tensile stress of 1.5 Kg/cm in width at a 10% longitudinal strain. Water soluble fabrics are undesirably stretched or changed in size when employed to manufacture chemical laces if they have a 10%-modulus smaller than 1 Kg/cm.

The invention will be described further with respect to the following detailed example which, of course, is not intended to be limiting, but rather as illustrative.

EXAMPLE

Webs having the weight per unit of area of 50 g/m$^2$ were prepared from hot water soluble polyvinyl alcohol fibers of 2 Denier having the length of 51 mm by means of carding. The resulting webs were transferred onto a conveyor made of wire mesh of 30 mesh size, and the webs were subjected to the action of pressurized water of 40 Kg/cm$^2$ sprayed out through a nozzle having a diameter of 0.3 mm to intertwine the fibers of the webs with each other. Fibrous sheets were obtained.

The resulting fibrous sheets were impregnated with 1.5% aqueous solution of water soluble polyvinyl alcohol resin and then dried and stretched by 50% in the direction of width. The resulting water soluble fabric showed 10% modulus of 1.5 Kg/cm, and an elongation at breakage of 15%. The resulting water soluble fabric possessed a remarkably low elongation and a remarkably high tensile strength. The patterns of embroidery did not get out of shape by the tension of an embroidering machine at all. Water soluble fabrics produced in accordance with this invention may have a tensile breaking strength of about 2.5 Kg/cm, measured using strips of about 5 cm width and 20 cm length.

In addition, non-woven fabrics manufactured in accordance with the present invention have the advantage that accidental slippage of an embroidering needle out of the fabric can be remarkably controlled relative to woven fabrics.

Further, water soluble fabrics manufactured according to the present invention have higher tensile strength in spite of smaller weights and could remarkably shorten the length of the dissolution process after embroidering, relative to conventional woven fabric. As a result, time and energy could be saved by about 30%.

Thus, according to the present invention remarkably useful non-woven fabrics useful for preparing chemical laces can be manufactured.

This invention has been described in terms of specific embodiments set forth in detail, but it should be understood that these are by way of illustration and that the invention is not necessarily limited thereto. Modifications and variations will be apparent from the disclosure and may be resorted to without departing from the spirit of this invention, as those of skill in the art will readily understand. Accordingly, such variations and modifications are considered to be within the purview and scope of this invention and the following claims.

We claim:

1. A method for manufacturing water soluble fabrics useful in the manufacture of chemical lace comprising:

a. intertwining webs comprised of a hot water soluble polyvinyl alcohol fiber by subjecting said webs to the action of fluid stream of provide a fibrous sheet at least a portion of which has highly intertwined fibers and increased fiber density, b. impregnating said fibrous sheet with a water soluble resin, c. stretching said sheet by at least about 20% in the direction of width of the sheet, and d. drying said sheet by the application of heat sufficient to adhere the resin to the fibers of the sheet.

2. The method according to claim 1 wherein the water soluble resin is selected from the group consisting of polyvinyl alcohol, polyethylene oxide, hydroxyalkylcellulose, carboxymethylcellulose, polyacrylamide, polyvinyl pyrrolidone, polyacrylate and starch.

3. The method according to claim 1 wherein said water soluble resin is polyvinyl alcohol and said fibrous sheet is comprised of loosely intertwined portions and portions which are highly intertwined having a higher fiber density than said loosely intertwined portions of the fibrous sheet.

4. The method according to claim 3 wherein the water soluble resin is comprised of about a 1.5% aqueous solution of polyvinyl alcohol resin, and the fabric is stretched by at least about 50% in the direction of the width of the fabric.

5. The method according to claim 4 wherein the fluid stream for intertwining portions of the web is water at a pressure of about 40 Kg/cm$^2$.

6. A method for manufacturing chemical lace comprising:

a. Intertwining webs comprised of a hot water soluble polyvinyl alcohol fiber by subjecting said webs to the action of a fluid stream to provide a fibrous sheet, b. impregnating said fiber sheet with a water soluble resin, c. stretching said sheet by at least about 20% in the direction of the width of the sheet, d. drying said sheet by the application of heat sufficient to adhere the resin to the fibers of the sheet, e. embroidering said water soluble fabric, and then dissolving away said water soluble fabric to provide a lace product, wherein said water soluble resin is polyvinyl alcohol and said fibrous sheet is comprised of loosely intertwined portions and of portions which are highly intertwined portions of the fibrous sheet.

7. A method for manufacturing water soluble fabrics useful in the manufacture of chemical lace comprising:

a. intertwining webs comprised of a hot water soluble polyvinyl alcohol fiber by subjecting said webs to the action of fluid stream to provide a fibrous sheet at least a portion of which has highly intertwined fibers and inceased fiber density, b. impregnating said fibrous sheet with a water soluble resin, c. stretching said sheet by at least about 20% in the direction of widths of the sheet, d. drying said sheet by the application of heat sufficient to adhere the resin to the fibers of the sheet, wherein said water soluble resin is polyvinyl alcohol and said fiberous sheet is comprised of loosely intertwined portions and portions which are highly intertwined having a higher fiber density than said loosely intertwined portions of the fiberous sheet, and said water soluble resin comprises at least about 60% by weight of the water soluble fabric.

* * * * *

UNITED STATES PATENT AND TRADEMARK OFFICE

CERTIFICATE OF CORRECTION

PATENT NO. : 4,570,311

DATED : February 18, 1986

INVENTOR(S) : Kawamura et al.

It is certified that error appears in the above-identified patent and that said Letters Patent is hereby corrected as shown below:

Column 1, line 45, change "1,500 kg." to --1,500 Kg.--.

Cloumn 3, line 24, change "lossely" to --loosely--.

Column 4, line 12, change "invention remarkably" to --invention, remarkably--.

Column 4, line 30, change "of provide" to --to provide--.

Column 4, line 61, change "Intertwining" to --intertwining--.

Column 6, line 2, change "incease" to --increased--.

Column 6, line 6, change "widths" to --width--.

Column 6, line 10, change "fiberous" to --fibrous--.

Column 6, line 13, change "fiberous" to --fibrous--.

Signed and Sealed this

*Thirtieth* Day of *September 1986*

[SEAL]

*Attest:*

DONALD J. QUIGG

*Attesting Officer*

*Commissioner of Patents and Trademarks*